US005085431A

United States Patent [19]

McGuire

[11] Patent Number: 5,085,431

[45] Date of Patent: Feb. 4, 1992

[54] GOLF TEE AND PLACEMENT TOOL

[76] Inventor: Robert M. McGuire, 1454 Everett Way, Roseville, Calif. 95678

[21] Appl. No.: 420,546

[22] Filed: Oct. 12, 1989

[51] Int. Cl.[5] ..... A63B 57/00

[52] U.S. Cl. ..... 273/33; 273/32 B

[58] Field of Search ..... 273/32 B, 32 R, 202–212, 273/33, 32.5

[56] References Cited

U.S. PATENT DOCUMENTS

| | | | |
|---|---|---|---|
| 1,550,483 | 8/1925 | Wulkop | 273/212 |
| 1,623,782 | 5/1927 | Dent et al. . | |
| 1,641,155 | 9/1927 | Clausing . | |
| 1,679,579 | 8/1928 | Lundy . | |
| 2,470,817 | 5/1949 | Hendricks | 273/207 |
| 2,606,764 | 8/1952 | Mason | 273/32 |
| 2,801,852 | 8/1957 | Hottle | 273/33 |
| 3,333,848 | 8/1967 | Budzinski | 273/33 |
| 3,559,998 | 2/1971 | Kelly | 273/212 |
| 3,633,919 | 1/1972 | Liccardello | 273/212 |
| 3,658,331 | 4/1972 | Driscoll | 273/32.5 |
| 3,671,037 | 6/1972 | Murdock, Jr. | 273/33 |
| 3,907,289 | 9/1975 | Bondu, Sr. | 273/33 |
| 4,660,837 | 4/1987 | Bressie | 273/32.5 |
| 4,905,999 | 3/1990 | Voinovich | 273/32.5 |

FOREIGN PATENT DOCUMENTS

| | | | |
|---|---|---|---|
| 519193 | 3/1940 | United Kingdom | 273/202 |

*Primary Examiner*—Theatrice Brown

*Attorney, Agent, or Firm*—Flehr, Hohbach, Test, Albritton & Herbert

[57] ABSTRACT

A golf tee (20) providing a pliant riser (22) and a rigid anchor (23). A placement tool (54) providing means for placement of said golf tee (20) into the ground. The anchor (23) having enough length and exposed surface area to provide the required friction needed to hold said golf tee (20) firmly in place even after being struck by a golf club used to hit a golf ball teed up on said golf tee (20). The placement tool (54) consisting of a tool handle (58), a tool shaft (59) and a tool sleeve (57) is used to place said golf tee (20) into the ground such that the anchor head (40) is below the ground surface a distance calibrated by the tee height indicator (30) on the riser (22).

8 Claims, 3 Drawing Sheets

GOLF TEE AND PLACEMENT TOOL

BACKGROUND

1. Field of Invention

This invention relates generally to a golf tee and placement tool and, more specifically, to a golf tee including a pliant riser and rigid anchor bottom, and to a placement tool, including a coring mechanism, for placement of said golf tee.

2. Description of Prior Art

Heretofore most golf tee designs limited the golfer to one hit per placement of the golf tee. The golf tee must be reposited by the golfer before another golf ball can be teed up due to the displacement of the golf tee by the force of the striking golf club. Some patented golf tees attempt to overcome this problem but each of them has a number of other disadvantages. U.S. Pat. No. 1,623,782 issued to Dent, Mackenzie and White (1927) and U.S. Pat. No. 1,641,155 issued to Clausing (1927) are two patents that addressed this problem with a single rigid piece. These designs yielded tees that were easier to find because they stayed in the ground but they still required repositioning because the striking golf club would alter their vertical alignment. U.S. Pat. No. 1,679,579 issued to Lundy (1928) has a resilient rubber support mounted on a rigid pin that has an annular barb. This golf tee design makes it very difficult to place or remove the tee because there is no rigid handle-like surface or external means for golf tee manipulation. U.S. Pat. No. 2,470,817 issued to Hendricks (1949) utilizes interlocking parts to provide a rigid means for turf insertion and flexible means for maintaining tee alignment. However, the golf tee has a minimum of 6 parts rendering the product susceptible to failure and complex to manufacture. In addition, this golf tee will not always return to the desired alignment due to the mechanical nature of the connected pieces. U.S. Pat. No. 3,633,919 issued to Liccardello (1972) has external means for placement of the golf tee. However, the objective of the Liccardello tee was to create an unbreakable tee that would not cut down on golf driving yardage. As a result the golf tee must still be reposited between uses. All of these golf tees, and others like them, have one or more of the following drawbacks.

(a) They are difficult to place into firm ground.

(b) They are hard to consistently place at the same height.

(c) They cannot work in conjunction with external golf ball teeing devices because the ball supporting surface of the golf tee does not maintain the same height or alignment achieved by the original placement of the golf tee.

Other types of golf tee designs have an external structure, such as a mat with a hole in it, or other device to anchor the tee in place. Tees in this group are usually bulky in size and may be permanently placed in the ground. These tees, and others like them, have one or more of the following drawbacks.

(a) They change the natural setup and stance of the golfer.

(b) They use materials that can damage golf clubs.

(c) They are too big to be conveniently carried by golfers.

(d) They are much more expensive than tradition golf tees.

(e) They are maintained by the operators and are not always kept in proper working order. This would include the absence of tees or the absence of tees of the desired height.

(f) They may catch the golf shoe spikes of the golfer and result in an injury to the golfer.

In addition to the disadvantages discussed above, many golf tee designs are not consistent with most golfer's expectations of what a golf tee should look like or how it should operate. This factor alone has prevented many golf tees from gaining public acceptance and achieving commercial success.

OBJECTS AND ADVANTAGES

Accordingly, besides the objects and advantages of the golf tee listed above, several objects and advantages of my invention are:

A. to provide a golf tee that the golfer does not have to reposit after a single hit or consecutive hits;

B. to provide a golf tee that maintains the height and alignment of the ball supporting surface such that it can be used with golf ball teeing devices;

C. to provide a golf tee that does not change the golfers natural set up or stance used to address a teed golf ball;

D. to provide a golf tee that is small enough to be carried by the golfer along with other golf equipment;

E. to provide a golf tee that will not damage golf clubs;

F. to provide a golf tee that, in conjunction with a placement tool, can be quickly placed in firm ground;

G. to provide a golf tee that can be manufactured of different heights and colors, or with colored markings, with each color representing a tee of a different height;

H. to provide a golf tee that has clear, distinctive markings which indicate when the golf tee has been placed properly into the ground and enables the golfer to set the golf tee to a desired predetermined height;

I. to provide a golf tee that is affordable to all golfers;

J. to provide a golf tee that can be used on a number of different occasions;

K. to provide a placement tool with means for removing and retaining a plug from the ground or other target material;

L. to provide a placement tool with means for ejecting a plug from inside the placement tool with minimal effort;

M. to provide a placement tool with means for gauging hole depths;

N. to provide a placement tool with means for transferring vertical and rotational forces to a golf tee;

O. to provide a placement tool with a tip which:

* prevents all horizontal movement of a golf tee during operation;
* can be used to break up hardened soil or other material;

P. to provide a placement tool which is about the size of a persons hand with handle means for gripping the tool;

Q. to provide a placement tool which can be easily disassembled and cleaned;

R. to provide a placement tool which minimizes potential risk to the users hands and fingers;

S. to provide a placement tool with a design that requires minimal tooling for production.

Further objects and advantages of my invention will become apparent from a consideration of the drawings and ensuing description of it.

DRAWING FIGURES

DESCRIPTION

Figure 4:
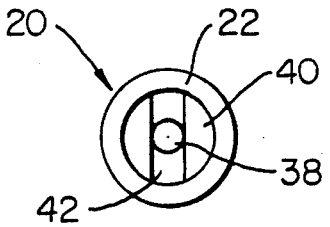
FIG. 4 is a top plan view of said golf tee embodiment.
Figure 2:
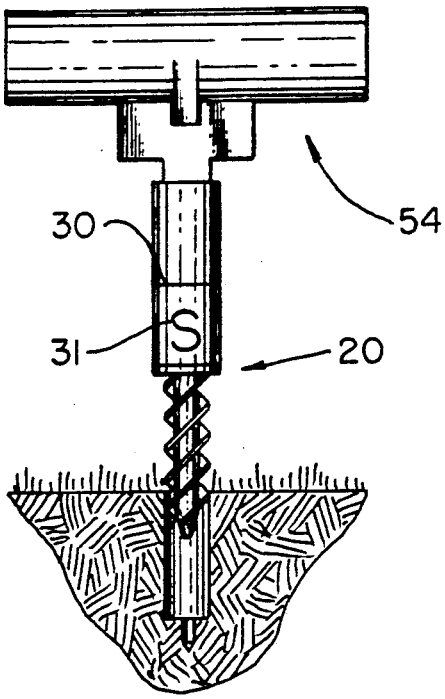
FIG. 2 is a front elevational view of a placement tool embodying my invention engaging the golf tee during tee placement.
Figure 3:
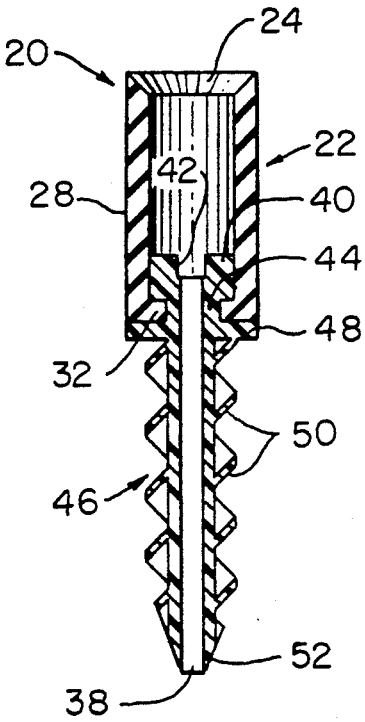
FIG. 3 is a side cross-sectional view of the golf tee.
Figure 1:
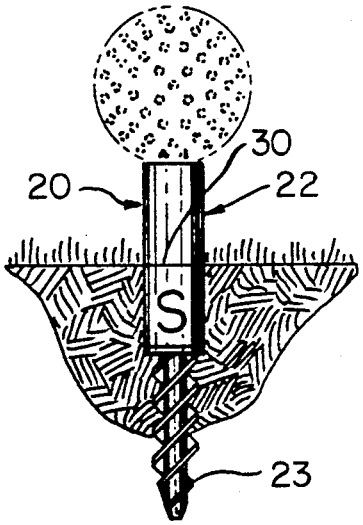
FIG. 1 is a front elevational view of a golf tee embodying my invention placed in the ground supporting a golf ball.

FIG. 1 is a side elevational view showing a golf tee 20 placed in the ground in accordance with the preferred embodiment of my invention. The golf tee 20 consists of a riser 22 and an anchor 23 with a placement tool to be presently described. FIG. 2 provides a side elevational view of the tee during placement. FIGS. 3 and 4, respectively, are side cross-sectional and top plan views of said golf tee embodiment. The riser 22 is preferably made of a pliant material, such as rubber or a thermoplastic elastomer, and has a vertically oriented tubular riser wall 28. A ball supporting surface 24 is formed by the riser wall 28 at the top of the riser 22. The riser wall 28 terminates in a lower riser base disc 32 which has a vertical hole passing through its center. A tee height indicator 30 is located on the external surface of the riser wall 28. The tee height indicator 30 may be an effect of a change in color, texture or structure on the external surface of the riser wall 28. There may be a tee size indicator 31 such as a molded or marked symbol on the external surface of the riser wall 28. The riser 22 is affixed to the anchor 23 which has a rod-like shape and is preferably made of a rigid material such as plastic, metal or wood. Passing through the vertical axis of the anchor 23 is a stabilizer bore 38 that has a diameter which is about one-fourth that of the anchor 23. The anchor 23 has an anchor head 40 which fits inside of the riser wall 28. An anchor neck 44 is formed by a notch at the base of the anchor head 40. Means for interlocking the riser 22 and the anchor 23 is provided by the anchor neck 44 that accommodates and holds the riser base disc 32. Said means may be reinforced with a glue substance, a welded joint or an external piece of material. The top of the anchor head 40 has a torque transfer slot 42 and terminates at an anchor shoulder 48. The riser base disc 32 sits on the anchor shoulder 48 which is at the top of an anchor body 46 which extends down to an anchor point 52 at the bottom of the anchor 23. There are three spiralled flutes descending clock-wise down the anchor body 46 which produce three anchor threads 50 which stop at the anchor point 52. The anchor threads 50 preferably are molded into the anchor body 46 but they may be the result of an operation, such as cutting, performed on the anchor body 46.

Figure 6:
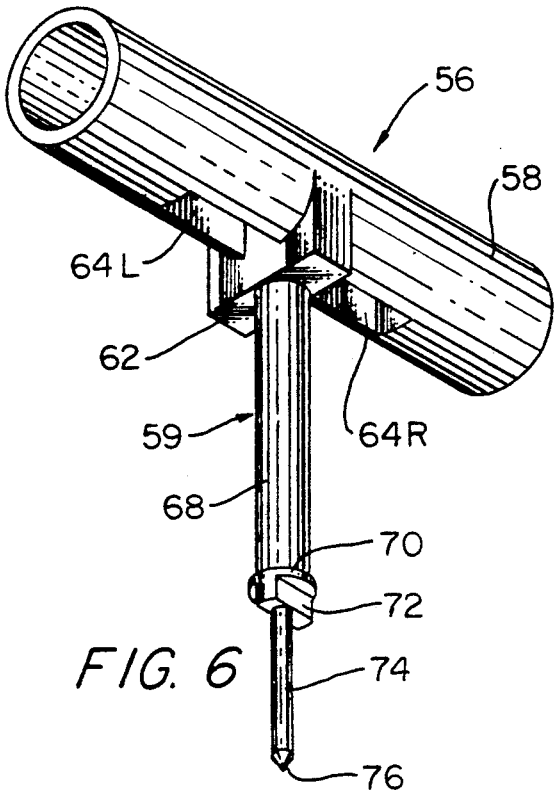
FIG. 6 is a perspective view of a body portion of the placement tool.
Figure 8:
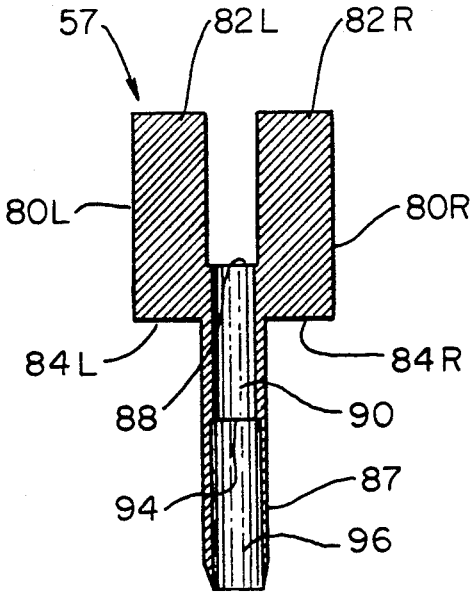
FIG. 8 is a front cross-sectional view of a sleeve portion of said placement tool embodiment.
Figure 5:
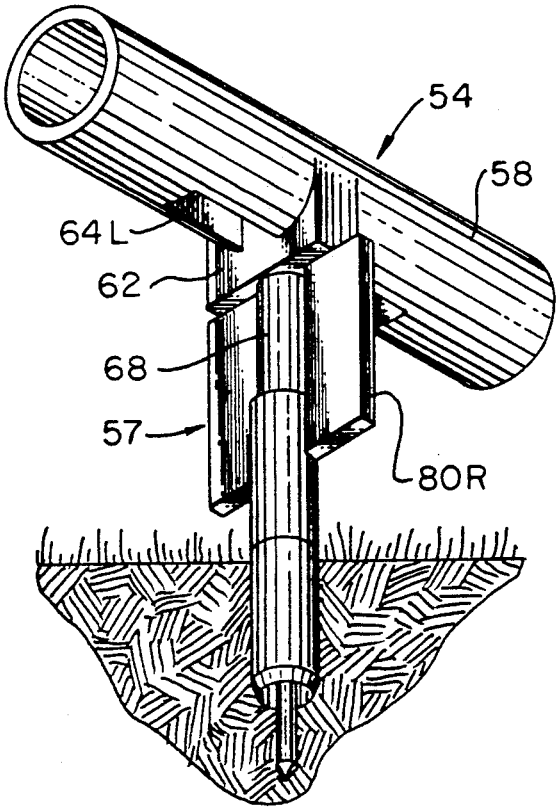
FIG. 5 is a perspective view of the placement tool embedded in the ground during operation with the sleeve portion of said placement tool in its extended position for the purpose of coring the ground.
Figure 7:
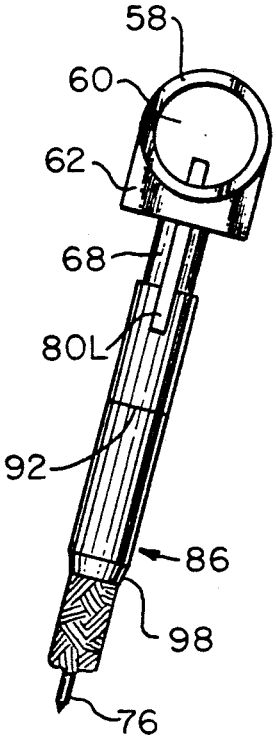
FIG. 7 is a side elevational view of the placement tool during operation while said sleeve portion is being retracted to a recessed position exposing a dirt plug (shaded) which has been removed from the ground.
Figure 9:
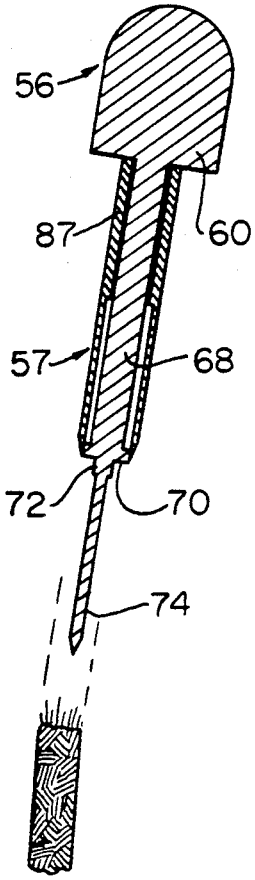
FIG. 9 is a side cross-sectional view of said placement tool with the sleeve fully retracted and said dirt plug (below) discharged from the tool.

FIG. 5 shows a perspective view of a placement tool with the preferred embodiment of my invention designated by 54. The placement tool 54 comprises a tool body 56 and a tool sleeve 57. FIG. 6 is a perspective view of the tool body 56. FIG. 7 is a side elevational view of the placement tool 54 with the tool sleeve 57 partially extended. FIG. 8 is a sectional elevational view of the tool sleeve 57. The tool body 56 is T shaped, preferably made of a rigid material, such as metal, plastic, wood or a combination thereof, and comprises a tool handle 58 and a tool shaft 59. The tool handle 58 is a tubular piece that forms the horizontal cross piece of the T shaped tool body 56. The tubular tool handle 58 is filled at the mid point forming a tool shaft housing 60, shown in FIG. 7. Extending downward from the tool shaft housing 60, perpendicular to the tool handle 58, is a rectangular sleeve stop 62. The uppermost portion of the sleeve stop 62 encompasses the lower half of the external surface of the tool handle 58. The sleeve stop 62 preferably has a depth equal to the diameter of the tool handle 58. The width of the sleeve stop 62 is preferably about one-third of the depth. On each side of the sleeve stop 62 there is a thrust fin slot, designated 64R and 64L, in the tool handle 58. The thrust fin slots 64R and 64L have the same axis which is parallel to the longitudinal axis of the tool handle 58. Extending down from the center of the sleeve stop 62 surface is a torque shaft 68 which terminates with a sleeve retaining cincture 70. The sleeve retaining cincture 70 is slightly larger in diameter than the torque shaft 68. FIG. 9 is a side cross-sectional view of the placement tool 54 which shows the relative positions of the sleeve retaining cincture 70 and the tool sleeve 57 when the sleeve is fully retracted. Extending down from the sleeve retaining cincture 70 is a torque transfer blade 72 whose longitudinal axis is parallel to the longitudinal axis of the tool handle 58. The length of the torque transfer blade 72 is about equal to the diameter of the torque shaft 68. The depth of the torque transfer blade 72 is almost one-half of its length. Extending down from the torque transfer blade 72 is a stabilizer shaft 74 which has a stabilizer tip 76 at the lower end. FIG. 8 is a front cross-sectional view of the tool sleeve 57 which is separable from the tool body 56. The tool sleeve 57 fits over the tool shaft 59 and is rotatable about the axis of the tool shaft 59. The tool sleeve 57 is made of a rigid material, such as metal, plastic, wood or a combination thereof, and comprises a pair of thrust fins, designated 80R and 80L, and a tube 86 which has a vertical longitudinal axis. The tube 86 has a tube wall 87 and an open tube end 88 at the top of the tube 86. The tube 86 has two different inside diameters. The upper part of the tube 86 has a guide tube 90 which is slightly larger in diameter than the torque shaft 68. At about the mid point of tube 86 there is a retaining edge 94 where the inside diameter increases in size. On the external surface of the tube 86, near the retaining edge 94, is a plug depth indicator 92. The depth indicator 92, FIG. 7, is a visible surface irregularity on the external surface of the tube 86. The depth indicator 92 may be the effect of a change in color, texture or structure on the external surface of the tube 86. The retaining edge 94 separates the guide tube 90 from a plug receptor 96 which has a slightly larger diameter than the sleeve retaining cincture 70. The plug receptor 96 is terminated with a beveled wall 98 which is at the open bottom end of tube 86. The planar rectangular thrust fins 80R and 80L are diametrically opposed on the external surface of the tube 86. The plane of the thrust fins 80R and 80L is parallel to the longitudinal axis of the tube 86. The thrust fins 80R and 80L extend upward past the tube end 88 for about two-thirds of their total length. Each thrust fin 80R and 80L has a thrust base 82R and 82L at the top and a retraction handle 84R and 84L at the bottom.

Figure 11:
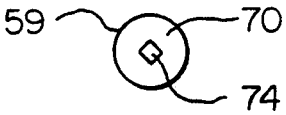
FIG. 11 is a bottom plan view of a tool shaft part of a placement tool illustrating said second embodiment of my invention.
Figure 10:
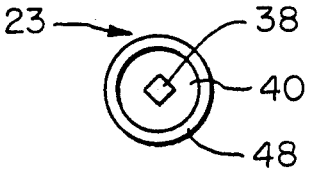
FIG. 10 is a top plan view of a golf tee illustrating a second embodiment of my invention.

FIGS. 10 and 11 are, respectively, a top plan view of an anchor 23 and a bottom plan view of a tool shaft 59 part of a placement tool 54 illustrating a second embodiment of my invention. This embodiment entails the stabilizer shaft 74 and the stabilizer bore 38 having specific matching shapes. This embodiment eliminates the need for the torque transfer blade 72 on the tool shaft 59.

Figure 12:
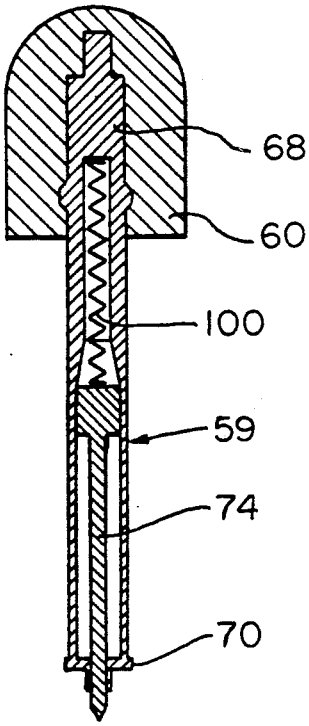
FIG. 12 is a side cross-sectional view of a tool body part of a placement tool illustrating a third embodiment of my invention.

FIG. 12 is a side cross-sectional view of a tool body 56 of a placement tool 54 illustrating a third embodiment of my invention. This embodiment reflects a tubular tool shaft 59 which houses a stabilizer spring 100 in its upper portion and a movable stabilizer shaft 74 in its lower portion. This third embodiment provides a safer tool body 56 whereby the stabilizer shaft 74 retracts when any pressure is applied to the end of the shaft. This third embodiment also illustrates the tool shaft 59 being separable from the shaft housing 60.

Figure 13:
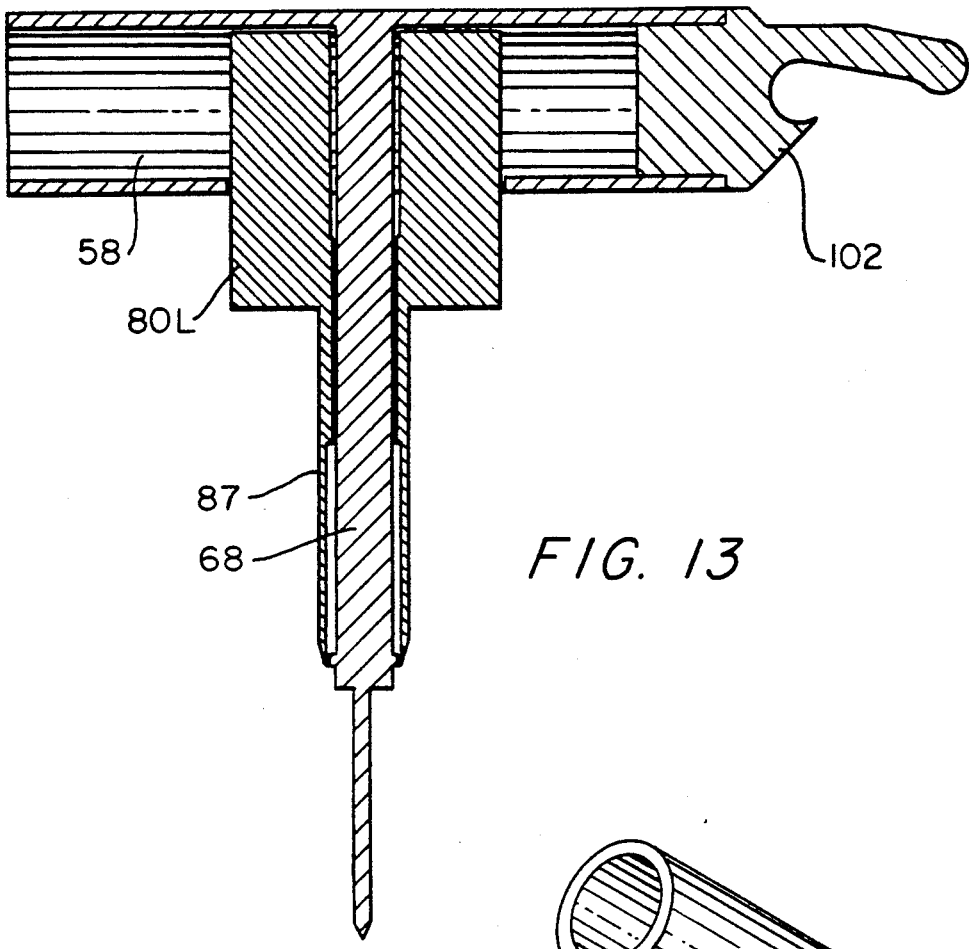
FIG. 13 is a front cross-sectional view of a placement tool illustrating a fourth embodiment of my invention.

FIG. 13 is a front cross-sectional view of a placement tool 54 illustrating a fourth embodiment of my invention. With this embodiment a secondary part 102 (a bottle opener device) is placed into the hollow end of the tool handle 58 whereby the functionality of the placement tool 54 is augmented.

Figure 14:
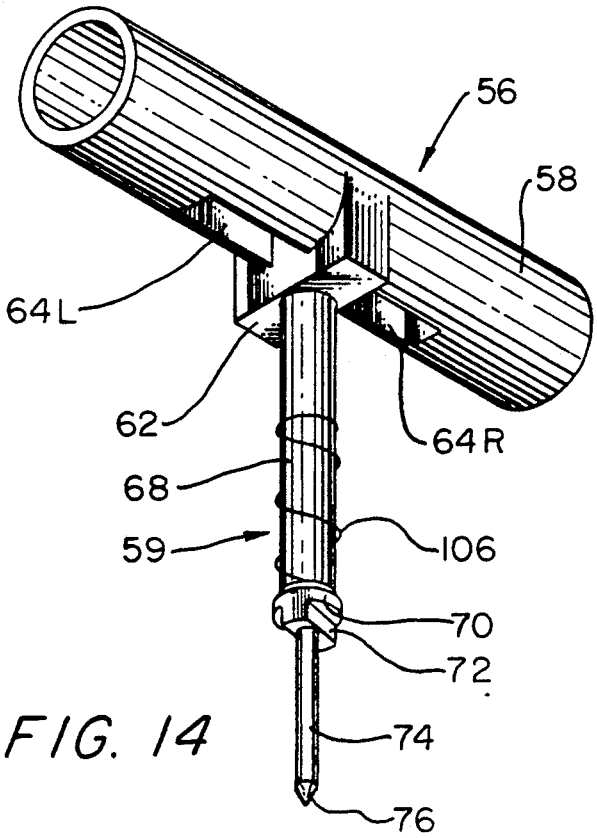
FIG. 14 is a perspective view of a body portion of a placement tool illustrating a fifth embodiment of my invention.

FIG. 14 is a perspective view a tool body 56 of a placement tool 54 illustrating a fifth embodiment of my invention. This embodiment has a sleeve return spring 106 providing the tool sleeve 57 and the tool handle 58 with equal opposite forces such that the tool sleeve 57 remains in the desired position.

OPERATION

FIGS. 1, 2, 5, 7 and 9 illustrate the operation of my invention. In use, the placement tool 54 must first be assembled by placing the tool shaft 59 between the thrust fins 80R and 80L and sliding the tool shaft 59 into the tube 86. The tool sleeve 57 is rotated such that the thrust fins 80R and 80L are aligned with the thrust fin slots 64R and 64L. The tube end 88 is pulled up against the sleeve stop 62 using the retraction handles 84R and 84L at the bottom end of the thrust fins 80R and 80L. The object of the operation of the placement tool 54 is to place the golf tee 20 into the ground with a vertical alignment. A user of the placement tool 54 does so by grasping the tool handle 58 with one hand. Using the other hand, the tool sleeve 57 is pulled away from the tool handle 58 until the thrust bases 82R and 82L of the thrust fins 80R and 80L are past the sleeve stop 62. The tool sleeve 57 is rotated ninety degrees and pushed back toward the tool handle 58 until the thrust bases 82R and 82L are resting against the sleeve stop 62. With the tool handle 58 firmly in grasp and the tool shaft 59 as vertical as possible, the placement tool 54 is pushed into the ground at the desired location. Once the placement tool 54 is far enough into the ground, as shown by the plug depth indicator 92, the placement tool 54 is extracted from the ground. The tool sleeve 57, is now rotated ninety degrees so that the thrust fins 80R and 80L are aligned with the thrust fin slots 64R and 64L. Using the retraction handles 84R and 84L the tool sleeve 57 is pulled back towards the tool handle 58 until the tube end 88 rests against the sleeve stop 62. This action causes the sleeve retaining cincture 70 to push out any dirt that has collected in the plug receptor 96. The user must now clean away any dirt that has collected on the torque transfer blade 72 or the stabilizer shaft 74. The golf tee 20 is now placed on the placement tool 54 by passing the stabilizer shaft 74 through the riser 22 and into the stabilizer bore 38 until the torque transfer blade 72 comes into contact with the anchor head 40. To ensure the torque transfer blade 72 is aligned with the torque transfer slot 42, the golf tee 20 is rotated while a slight pressure is applied to the tool handle 58 until the placement tool 54 and golf tee 20 are locked together. Preferably, the diameter of the tool sleeve 57 is large enough such that the outside surface contacts the inner wall of the riser 22 with enough pressure to retain the golf tee 20 on the placement tool 54 without user assistance. The anchor point 52 is now placed in the hole in the ground created by the above mentioned operation. While applying a downward pressure on the golf tee 20 via the placement tool 54, the tool handle 58 is rotated in a clock-wise direction until the golf tee 20 has been forced into the ground to such an extent that the tee height indicator 30 is even with the soil. This should be accomplished after a few revolutions of the tool handle 58. The placement tool 54 is now pulled up leaving the golf tee 20 correctly placed in the ground. The user now places a golf ball on the ball supporting surface 24 and hits the ball. The user may then remove the golf tee 20 or tee up additional golf balls while striking them in consecutive fashion. When finished, the user removes the golf tee 20 by placing the placement tool 54 back into the golf tee 20 and setting the torque transfer blade 72 into the torque transfer slot 42. The user must then turn the tool handle 58 counter clock-wise until the golf tee 20 is loose in the ground. The user then removes the placement tool 54 and pick ups the golf tee 20.

If the soil is too hard to push the placement tool 54 into it then the user may use the stabilizer shaft 74 to break up the soil. This is done with the tool sleeve 57 in the retracted position. The user grasps the placement tool 54 by the tool handle 58 and thrusts the stabilizer shaft 74 into the ground until the torque transfer blade 72 comes into contact with the soil. This action is repeated until the placement tool 54 can be thrust into the ground per above mentioned instructions.

FIGS. 10 and 11 are, respectively, a top plan view of an anchor 23 and a bottom plan view of a tool shaft 59 part of a placement tool 54 illustrating a second embodiment of my invention. The operation of this embodiment is the same as the operation described for the first embodiment except that the tool body 56 must be rotated relative to the tool sleeve 57 before the stabilizer shaft 74 enters the stabilizer bore 38.

FIG. 12 is a side cross-sectional view of a tool body 56 of a placement tool 54 illustrating a third embodiment of my invention. The operation of this embodiment is the same as the operation described for the first embodiment except that the stabilizer shaft 74 cannot be used to soften the soil. In addition, there will be less dirt to clean from the tool during operation since the retracting stabilizer shaft 74 will act as a dirt plug ejector.

FIG. 13 is a front cross-sectional view of a placement tool 54 illustrating a fourth embodiment of my invention. The primary operation of this embodiment is the same as the operation described for the first embodiment. A secondary function is possible whose operation normally requires the user to grasp the placement tool 54 by the tool sleeve 57 and tool shaft 59 to manipulate the secondary part 102 (a bottle opener device) to effect its operation.

FIG. 14 is a perspective view a tool body 56 of a placement tool 54 illustrating a fifth embodiment of my invention. The operation of this embodiment is the same as the operation described for the first embodiment.

The golf tee has been placed such that the head of the rigid anchor is below ground level with only the pliant riser extending up beyond the surface. Thus the golf tee and placement tool of this invention provide:

1. a golf tee that
   * has a superior anchor which stays in place after the golf tee has been struck by a golf club;
   * maintains the height and alignment of the golf ball supporting surface;
   * provides the above mentioned advantages without requiring the golfer to change their stance or the way they address a golf ball teed on this invention;
   * provides the above mentioned advantages and yet is small enough to be carried along with other golf equipment by the golfer;
   * does not damage or mar the golf club;
   * can be placed in ground that may be more firm than normally found in golfing situations;
   * can be manufactured in various heights and colors thus providing means to easily choose golf tees of the correct height;
   * provides means to consistently place the golf tee at a predetermined desired height;
   * is a cost effective solution for the above mentioned problem that is affordable to all golfers;
   * is durable and can be used many times before wear renders the product inoperable;
   * is consistent with a golfer's expectations of size and design of a normal golf tee; a singular vertical piece that is placed into the ground and is obscured from view by a teed golf ball;
   * actually improves the condition of the golf surface by breaking up the soil, thereby improving turf aeration;
2. a placement tool that:
   * provides means for removing and retaining a plug from the ground or other target material;
   * ejects the retained plug from the placement tool when the component parts are restored to their normal position;
   * provides means for gauging plug depths;
   * provides means for transferring vertical and rotational forces to a golf tee;
   * has a rigid tip which:
     prevents horizontal movement of a golf tee during placement;
     can be used to break up soil or other material;
   * is about the size of a persons hand with handle means for gripping the tool;
   * has interfitted parts which require a distinct manipulation or force to effect their disconnection thus rendering the device ready to use and minimizing the risk of loosing one the parts;
   * can be quickly disassembled and cleaned;
   * minimizes the potential risk to the users hands and fingers;
   * is of a simple design that requires minimal tooling and production facilities;
   * could be used to make holes of different depths or diameters with minor design modifications.

Although the description above contains many specificities, these should not be construed as limiting the scope of the invention but as merely providing illustrations of some of the presently preferred embodiments of this invention. For example, the riser of the golf tee could be of a different shape, height or colors, with different colors or shapes designating tees of different heights; there could be more than one tee height indicator on the tee riser; the anchor could be of different lengths, colors, or even of a different shape such as tubular, fluted rod, fluted, etcetera; the placement tool can have a variety of embodiments that would change the shape, breadth and depth of the hole that is made. In addition, there could be more than one plug depth indicator on the anchor sleeve tube of the placement tool; the shaft and the handle of the placement tool may have a hinge type connection or even disassembled for storage purposes; the placement tool could have other useful devices built into the basic design. For example, the end of the tool handle could function as a shoe spike wrench, bottle opener, green repair tool, etcetera, or have a storage compartment that could hold ball markers, shoe spikes, golf tees, coins or any other useful item. In addition, the placement tool, with minor modifications, could be used in gardening, cheese testing or any other application that requires a hole to be made in, or a core sample to be taken from, an object material. Thus the scope of the invention should be determined by the appended claims and their legal equivalents, rather than by the examples given.

I claim:

1. In combination, a golf practice device that supports a golf ball above the ground at a desired height, a portion of the device remaining in the ground until its desired removal by a golfer, said golf ball freeing device comprising;

(a) a golf tee having a pliant riser portion to support a golf ball and a rigid anchor portion having a spiraling flute on its external surface to secure said tee in the ground, said anchor having a stabilizer bore passing through its longitudinal axis;

(b) a placement tool for engaging and placing said golf tee in the ground comprising a tool handle, a torque shaft secured to said handle for engaging the anchor and a stabilizer extending from the torque shaft into the stabilizer bore and sleeve means for making a hole in the ground slidably carried with and by said torque shaft for engaging the ground and making said hole whereby said anchor is inserted into said hole for placement of said golf tee into the ground; and (c) interlocking means for transferring vertical and rotational forces applied to said placement tool via the shaft to said anchor whereby said anchor can be screwed into the ground at said hole.

2. The golf tee of claim 2 wherein said riser has height display means for indicating when said golf tee is at the correct height during placement whereby the tee can be placed consistently at the same height.

3. The practice device of claim 1 wherein said interlocking means is provided by said stabilizer bore and said stabilizer whereby forces applied to said tool handle are transferred to said anchor of said golf tee through said stabilizer.

4. The practice device of claim 3 wherein said interlocking means is at least one blade at the end of said shaft and at least one corresponding notch at the top of said anchor for receiving said at least one blade.

5. The practice device of claim 1 wherein said stabilizer bore and said stabilizer have correspondingly matched shapes providing said interlocking means whereby rotational forces applied to said tool handle are transferred to said anchor of said golf tee through said stabilizer.

6. The placement tool of claim 1 wherein said stabilizer is retractable into said sleeve means whereby said stabilizer retreats into said sleeve means when force is applied to the stabilizer whereby the risk of injury to a golfer by the stabilizer is reduced.

7. The placement tool of claim 1 wherein said placement tool has retaining means for holding said golf tee on said placement tool during placement of said golf tee whereby said golf tee remains in position on said placement tool until the tee is placed in the ground or removed by the golfer.

8. The placement tool of claim 7 wherein said retaining means is friction.

* * * * *